US007198001B1

(12) United States Patent
Lewis et al.

(10) Patent No.: US 7,198,001 B1
(45) Date of Patent: Apr. 3, 2007

(54) UNDERWATER INSPECTION MEASUREMENT SURVEY

(75) Inventors: William H. Lewis, Gaithersburg, MD (US); Dana C. Lynn, Severna Park, MD (US); Andrew J. Field, Rockville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/272,420

(22) Filed: Nov. 8, 2005

(51) Int. Cl.
*B63G 8/00* (2006.01)

(52) U.S. Cl. ..... 114/312; 367/129

(58) Field of Classification Search ..... 114/222, 114/312, 313, 330, 331, 337, 338; 73/603, 73/626, 865.8; 414/4
See application file for complete search history.

(56) References Cited

U.S. PATENT DOCUMENTS 4,227,853 A * 10/1980 Woodford et al. ..... 414/4
4,628,991 A 12/1986 Hsiao et al.
5,097,780 A * 3/1992 Winchester ..... 114/330
5,193,405 A 3/1993 Oomichi et al.
5,947,051 A * 9/1999 Geiger ..... 114/313
5,992,246 A 11/1999 Nice
6,041,646 A 3/2000 Fenlon
6,317,387 B1 * 11/2001 D'Amaddio ..... 114/222
6,928,947 B1 * 8/2005 Clapham ..... 114/312

* cited by examiner

*Primary Examiner*—Lars A. Olson
(74) *Attorney, Agent, or Firm*—Jacob Shuster

(57) ABSTRACT

A platform assembly of circular plates are yieldably held positioned by a support mounted on an underwater vehicle propelled under remote control within seawater to a location below an underwater surface such as the bottom of a ship hull, for surface measurement survey of such surface through sensors that are projected upwardly from the positioned platform assembly into contact with the surface under spring bias pressure established during survey measurement.

5 Claims, 3 Drawing Sheets

UNDERWATER INSPECTION MEASUREMENT SURVEY

The present invention relates generally to underwater survey measurement of surfaces such as ship hulls and tanks requiring periodic inspection.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Remotely operated underwater mobile vehicles with measurement facilities thereon are utilized for underwater inspection survey of ship hull surfaces. Such survey is repeatedly performed by personnel to provide valuable data on surface status of the ship hulls. The measurement facilities utilized have been a source of hindrance and cause of damage to the sensing instruments associated therewith and the coatings on the hull surfaces being surveyed, because of the repetitive contact of the sensing instruments with the surfaces being surveyed under compliant personnel control during high-speed underwater movement of the sensing instruments on the mobile vehicle.

Facilities for surface measurement sensing and underwater surface survey of ship hulls as hereinbefore referred to are disclosed in U.S. Pat. No. 4,628,991 to Hsiao et al., U.S. Pat. No. 5,193,405 to Oomichi et al., U.S. Pat. No. 5,992,246 to Nice and U.S. Pat. No. 6,041,646 to Fenlon.

It is therefore an important object of the present invention to avoid the disadvantages heretofore experienced during surface survey of ship hulls.

SUMMARY OF THE INVENTION

Pursuant to the present invention, measurement sensors are mounted on a mobile underwater vehicle by parallel spaced platform plates of a support assembly to survey a ship hull. The platform plates hold the sensors in contact with the ship hull surface during survey measurement under the bias of coil-wound spring cables connected to and positioned under compression between the plates during measurement. Wires connected to the sensors transmit data signals therefrom to a remote location at which personnel may evaluate the measurement data collected thereat to exercise compliant control over movement of the mobile vehicle and positioning of the sensors.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
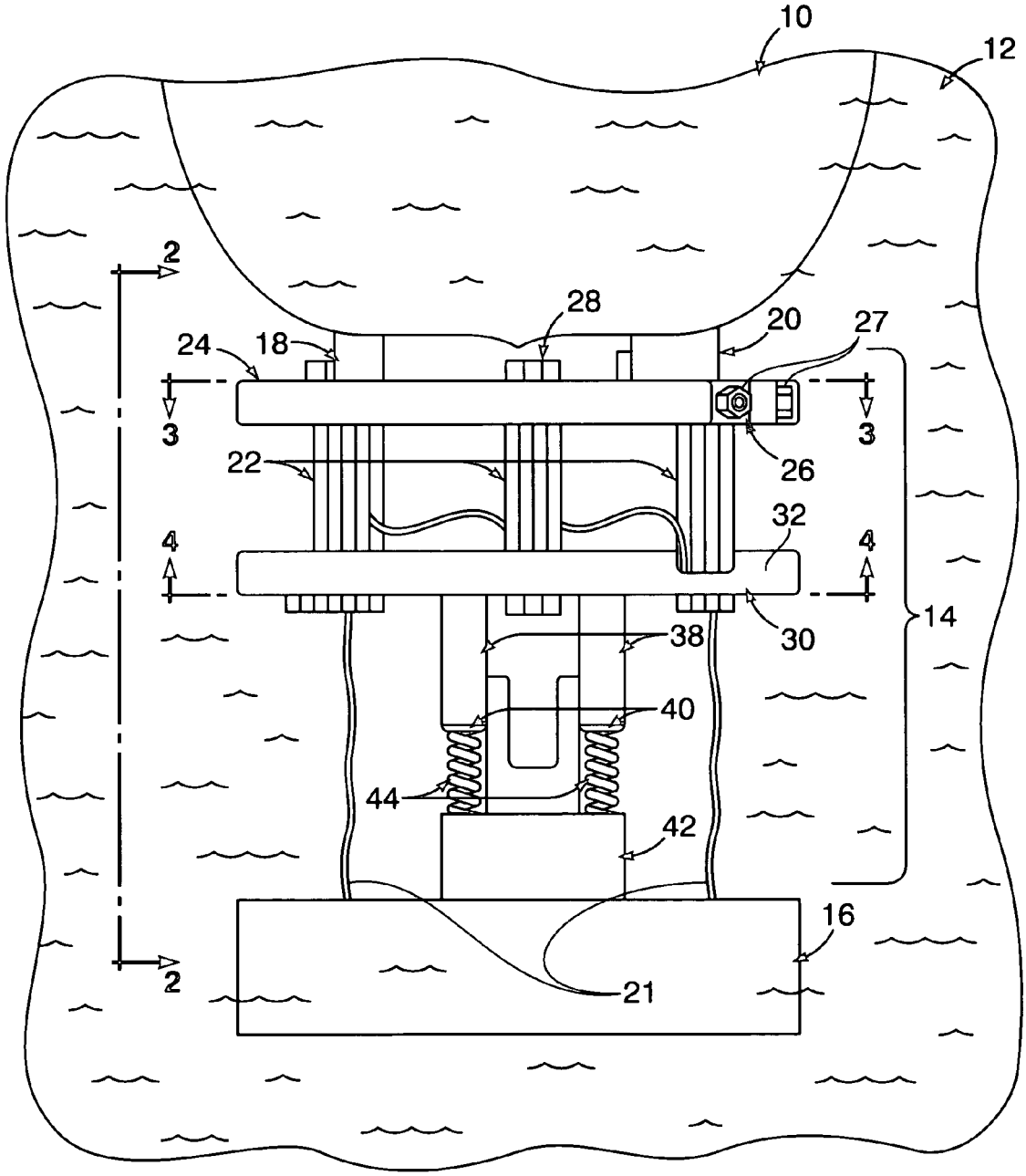
FIG. 1 is a side elevation view of an underwater mobile vehicle with survey measurement apparatus positioned thereon below an underwater bottom surface of a ship hull to be surveyed.

Referring now to the drawing in detail, FIG. 1 illustrates a bottom portion of a ship hull 10 immersed within a body of seawater 12. The ship hull 10 is being subjected to inspection by use of survey measurement apparatus 14 mounted on an underwater vehicle 16 that is propelled to a location below the ship hull 10 as shown in FIG. 1, under remote control of personnel at some remote location. The apparatus 14 has associated therewith an ultra-sonic thickness (UT) sensor 18 and a dry-film thickness (DFT) sensor 20 which are held in contact with the hull 10 during survey measurement under pressure. Measurement data signals are dispatched from the sensors 18 and 20 through wiring 21 extending into the vehicle 16 through which the signals are transmitted to the aforementioned remote control location for performance of the hull surface survey after involving adjustable positioning of the sensors 18 and 20 as shown in FIG. 1 by motor operated means under personnel control as generally known.

Figure 2:
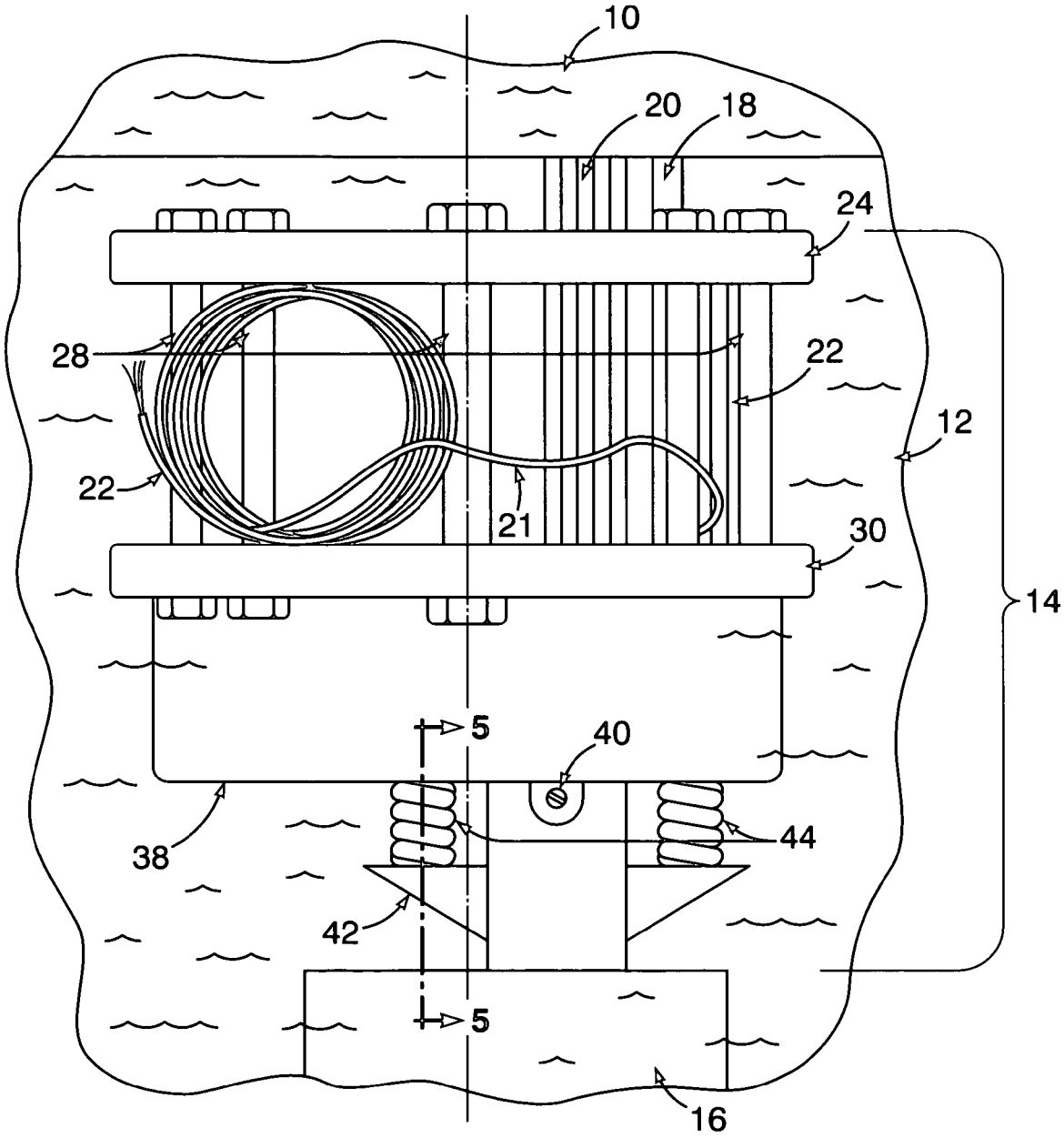
FIG. 2 is a partial side elevation view as viewed from a plane indicated by section line 2—2 in FIG. 1.
Figure 3:
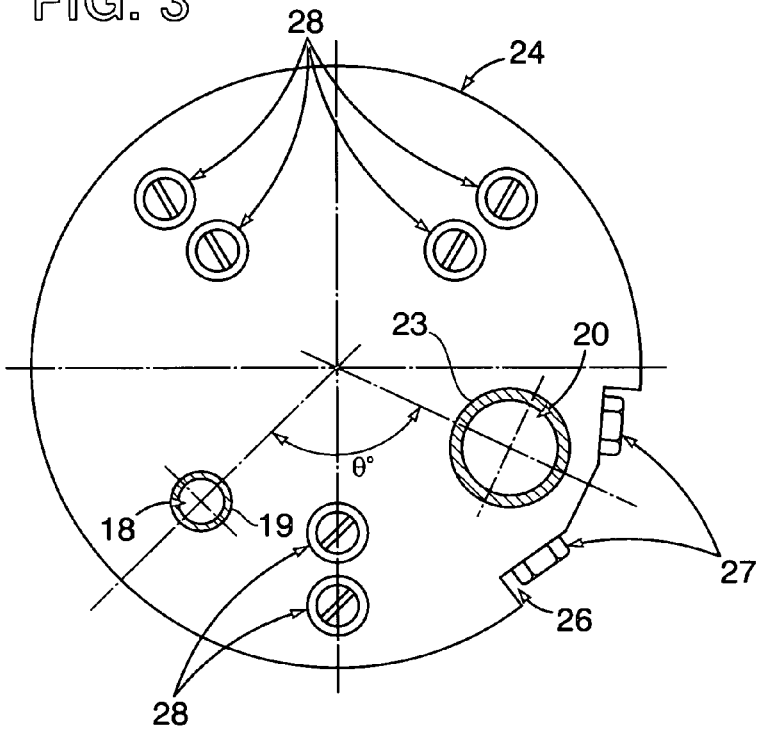
FIGS. 3 and 4 are section views taken substantially through planes indicated by section lines 3—3 and 4—4 in FIG. 1.
Figure 4:
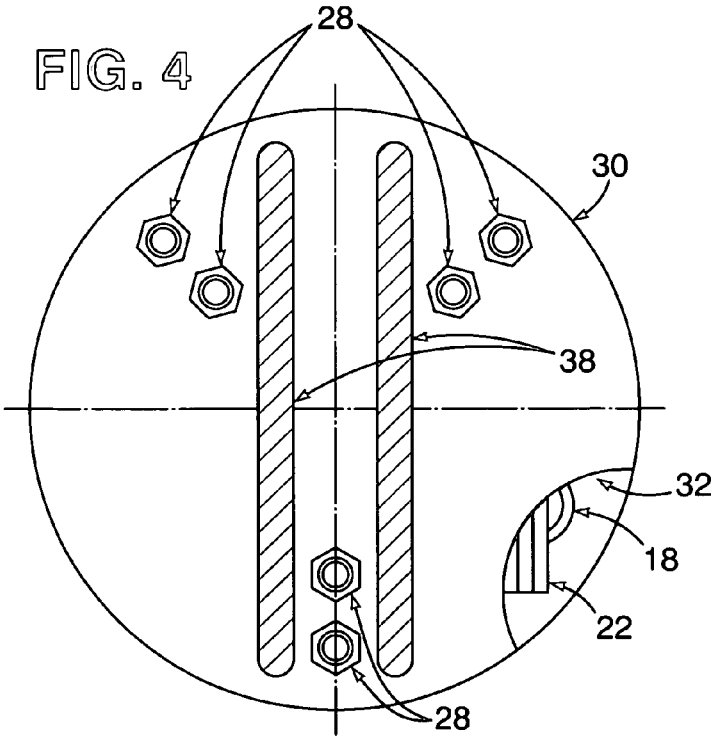

Pursuant to the present invention, wound spring cables 22 supported on the vehicle 16 are part of the survey measurement apparatus 14 with the sensors 18 and 20 maintained in contact with the hull 10 under pressure. As shown in FIGS. 1–4, the apparatus 14 also includes a top platform plate 24 floatingly positioned within the seawater 12 just below the ship hull 10. Holes 19 and 23 are formed in the top plate 24, as shown in FIG. 3, through which the sensors 18 and 20 are projected upwardly in angularly spaced relation to each other by θ° as also diagrammed in FIG. 3. A recess 26 is formed within the circular periphery of the top plate 24 as shown in FIG. 3 to expose the heads of one pair of horizontal set-screw fasteners 27, so as to hold the sensors 18 and 20 in the plate 24. Three pairs of vertical set-screw fasteners 28 as shown in FIG. 3 are positioned on the top plate 24 located above a base plate 30 as shown in FIGS. 1 and 2. The sensor 18 and upper portions of the spring cables 22 are thereby held in place, while the spring cables 22 are held in place between the top plate 24 and the base plate 30 under compression. A recess 32 as shown in FIGS. 1 and 4 is formed in the circular periphery of the base plate 30 in alignment with the recess 26 in the top plate 24 to expose the bottom portion of one of the spring cables 22. The sensors 18 and 20 together with the spring cables 22 are accordingly held in position between the plates 24 and 30 while accommodating facilitated assembly and disassembly of the apparatus 14.

Figure 5:
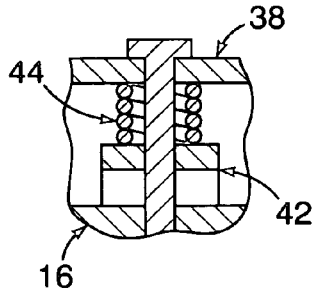
FIG. 5 is a partial section view taken substantially through a plane indicated by section line 5—5 in FIG. 2.

A pair of parallel spaced brackets 38 extend downwardly from the base plate 30 as shown in FIGS. 1 and 4 for pivotal connection of the apparatus 14 to the vehicle 16 by axially aligned pivot pins 40 extending into a pivot support 42 on the vehicle 16 as shown in FIGS. 1, 2 and 5. A pair of springs 44 are positioned on the pivot support 42 for engagement with the brackets 38 so as to yieldably hold the apparatus 14 in position with the sensors 18 and 20 in contact with the ship hull 10 under bias of the springs 44 and the spring cables 22 during surface survey measurement while providing signal data on surface conditions from the sensors 18 and 20 on surface conditions to the remote control location, such as the thickness of paint coating on the ship hull 10.

The foregoing described mounting arrangement for the sensors 18 and 20 on the vehicle 16 is useful for hull surface measurements without damage to the hull 10 or the sensors 18 and 20. Such sensor mounting arrangement may also be utilized for other underwater surface survey measurements, within tanks for example.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an inspection system for survey of an underwater surface by use of sensors on a remote controlled underwater vehicle, mounting means for adjustably positioning the sensors on the vehicle comprising: a platform assembly; support means for pivotally mounting the platform assembly on the vehicle; and spring means for yieldably holding the sensors in spaced relation to each other in contact with the underwater surface under spring bias, wherein said platform assembly comprises: a top plate from which the sensors project upwardly into said contact with the underwater surface; a base plate; spring-wound cable means positioned between said top and base plates under compression for maintaining the sensors in said contact with the underwater surface under said spring bias; and fastener means interconnecting the top and base plates in spaced relation to each other for holding the sensors and the spring wound cable means positioned therebetween.

2. The combination as defined in claim 1, wherein said support means comprises: brackets projecting downwardly from the base plate; a support element fixed to the vehicle; and pivot pins pivotally interconnecting the brackets with the support element.

3. The combination as defined in claim 2, wherein said top and base plates have circular peripheries with aligned recesses formed therein exposing one of the sensors and attachment thereof to the platform assembly.

4. The combination as defined in claim 3, wherein said underwater surface subjected to the survey is a ship hull.

5. The combination as defined in claim 1, wherein said top and base plates have circular peripheries with aligned recesses formed therein exposing one of the sensors and attachment thereof to the platform assembly.

* * * * *